US006142256A

United States Patent [19]

Dirk, II

[11] Patent Number: 6,142,256

[45] Date of Patent: Nov. 7, 2000

[54] FOLDING SAWHORSE

[75] Inventor: Henry E. Dirk, II, 1710 Sunrise Trail, Kingwood, Tex. 77339-4078

[73] Assignee: Henry E. Dirk, II, Houston, Tex.

[21] Appl. No.: 09/188,520

[22] Filed: Nov. 9, 1998

[51] Int. Cl.[7] ..... E04G 1/34; E04G 1/32

[52] U.S. Cl. ..... 182/153; 182/225

[58] Field of Search ..... 182/153, 225, 182/25

[56] References Cited

U.S. PATENT DOCUMENTS 1,819,252 8/1931 Linsner ..... 182/153

3,148,746 9/1964 Juculano ..... 182/153

4,245,718 1/1981 Poston et al. ..... 182/153

4,756,385 7/1988 Deitz et al. ..... 182/153

*Primary Examiner*—Daniel P. Stodola

*Assistant Examiner*—Hugh B. Thompson

*Attorney, Agent, or Firm*—Williams, Morgan & Amerson

[57] ABSTRACT

A folding sawhorse is formed from a pair of substantially identical rectangular frames. The frames are constructed from four substantially identical wooden members via lap joints to make a smooth construction. The frames are also pivotally joined together by a pair of hinges fixedly coupled to top portions thereof. A flexible member or chain extends between the frames, but is displaced from the hinges. The hinges allow for pivotal movement of the frames, while the chain limits the range of pivotal movement.

9 Claims, 10 Drawing Sheets

FOLDING SAWHORSE

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO A MICROFICHE APPENDIX

"Not Applicable"

BACKGROUND OF THE INVENTION

This invention relates to sawhorses and more particularly to folding sawhorses which are foldable in nature. Sawhorses are commonly employed by carpenters, painters, drywall installers, other workers and occasionally a homeowner; for a wide variety of reasons.

The traditional sawhorse is a rigid thing which is sturdy and well-adapted for work supporting operations. One of the limitations of traditional sawhorses is that they are ungraceful to store and transport because of their shape and the amount of room required. A folding sawhorse should readily unfold for use and fold up again for storage.

Homeowners often have work around the home where a sawhorse would make their project much easier and in some cases even safer, however, again the storage problems of conventional or fixed sawhorses discourage the homeowner from sawhorse ownership. Since most projects of the homeowner are of a short interval, if the sawhorse does not easily expand, and collapse, it will be seldom used.

The present invention is a strong, full sized sawhorse; that you can just pick up with one hand and hang on your garage wall; with the maximum projection from that wall being 1½ inches. This sawhorse is sturdy in it's stable work position, and yet instantaneously foldable to an insignificant volume for storage, and without complexity of operation.

Prior art sawhorses either are too cumbersome to transport if sturdy, or are unsturdy and time consuming if partially collapsible. In response to this disadvantage of fixed sawhorses, there have been proposals for knock-down sawhorses which may be disassembled for transportation and storage as exemplified in U.S. Pat. No. 2,829,927 April, 1958 and U.S. Pat No. 4,071,113 January, 1978.

Similarly, collapsible sawhorses have evolved in which the supporting legs may be swiveled from the diverging load supporting position to a generally parallel storage position as exemplified in U.S. Pat. No. 3,734,235 May, 1973, U.S. Pat No. 249,095 November, 1881 and U.S. Pat. No. 3,696,887 October, 1972.

Folding sawhorses therefore were created to solve the storage space problem and to allow for easier transportation.

Prior folding sawhorses had many shortcomings. Some prior folding sawhorses could not withstand sideways motion in the load they supported. This was especially a problem with the type of sawhorse described U.S. Pat. No. 4,884,658 Banfield Dec. 5, 1989. The legs of this type of folding sawhorse that were positioned on a common side of the sawhorse were not rigid with each other. The legs tended to swivel with relation to the upper central member of the sawhorse when the sawhorse was under load and therefore the sawhorse did not provide sufficient support when its load moved laterally with respect to the central supporting member.

Other folding sawhorses, such as the sawhorse described in U.S. Pat. No. 4,790,411 December, 1988, provided significantly less vertical support than did non-folding sawhorses. The legs of these sawhorses tended to curve outward under the pressure of applied weight because the sawhorse's opposing legs were not rigidly fixed to one another when the sawhorse was unfolded for use.

Some folding sawhorses, such as the "IRON HORSE" manufactured by the Hirsh Company of Skogie, Ill. are both rigid and sturdy because their four legs are fixed relative to one another, but are difficult to unfold and fold.

The plastic sawhorses as in; U.S. Pat. No. 5,351,785 DuRapau Oct. 4, 1994. States in part "To provide rigidity and strength and to also minimize weight and material usage the sawhorse components are preferably constructed of reinforced plastic resin molded into the desired form." This statement may be valid from a manufacturer point of view, however, the plastic sawhorses are not comparable to wood where strength is concerned. Furthermore the use of plastic; does of course blockade any of our citizens from building their own.

U.S. Pat. No. 4,429,765 Garcia Feb. 7, 1984 Collapsible sawhorse; was believed to be the closest prior art, to the present invention found, however, his statement "To illustrate the space savings afforded . . . . About one fifth of the storage volume required of the conventional sawhorse." while showing promise, is not comparable to the present invention.

When the full sized sawhorse of this invention is fully assembled; the rectilinear volume of this folding sawhorse; in it's stable work position, is 23040 cubic inches being 32 inches long, 24 inches wide at the base and 30 inches high. The rectilinear volume of this folding full sized sawhorse; in it's folded and ready for storage position, is 1536 cubic inches being 32 inches long, 1½ inches wide at the base and 32 inches high. The reduction ratio between the stable work position and the folded for storage position therefore is fifteen (15) to one (1), over a fixed conventional sawhorse of the same proportions in it's stable work position.

The goal of this invention is to provide an improved folding full size sawhorse having a substantial load carrying capacity, while still maintaining; a light weight for handling, and with an instant transformation, between; the ready for storage position and the stable work position. Other objects and advantages of this invention will become more fully apparent as this description proceeds, with reference being made to the accompanying drawing and appended claims.

BRIEF SUMMARY OF THE INVENTION

Goal: The goal of this invention is to provide an improved folding sawhorse in the six fields following:

(1) Uncomplicated: a basic full sized sawhorse, capable of folding, with a minimal amount of parts and uncomplicated;

(2) Strength: a full sized folding sawhorse with a substantial load carrying capability;

(3) Space saving: a full sized folding sawhorse that folds to a minimal volume for storage;

(4) Transition: a full sized folding sawhorse that moves easily between; it's stable work position, and it's folded for storage position;

(5) Weight: a full sized sawhorse that is, light weight for ease of handling;

(6) Composition: all materials close at hand and readily available.

Uncomplicated: This full sized folding sawhorse in it's stable work position forms the shape of an "A" and comprises: (a) two of frames, which form the oblique lines of the "A" shape, (b) two hinges with screws, are located at the pinnacle of the "A" shape and (c) two chains that form the cross on the "A" shape.

Strength: A pair of these folding full sized sawhorses, will support vertical loads in excess of one thousand pounds.

Space saving: The rectilinear volume of this folding full sized sawhorse; in it's stable work position, is 23040 cubic inches being 32 inches long, 24 inches wide at the base and 30 inches high. The rectilinear volume of this folding full sized sawhorse; in it's folded and ready for storage position, is 1536 cubic inches being 32 inches long, 1½ inches wide at the base and 32 inches high. The reduction ratio between the stable work position and the folded for storage position therefore is fifteen (15) to one (1).

Transition: Simply by setting down the nearer frame, and with a slight twist of the wrist set the bottom of the other frame away until the "A" shape is formed and the full sized folding sawhorse is in it's stable work position. Simply by picking it up the full sized folding sawhorse; it is ready for storage, when the bottoms of both frames clear the floor, gravity folds the full sized sawhorse to it's ready for storage position.

Weight: This full sized folding sawhorse will weight from 13 to 15 pounds; a pair of sawhorses of this invention weight no more than a three gallon pail of water, and can easily be handled by a one armed person.

Composition: All components of this folding sawhorse can be readily found at the local store.

DETAILED DESCRIPTION OF THE INVENTION

Figure 1:
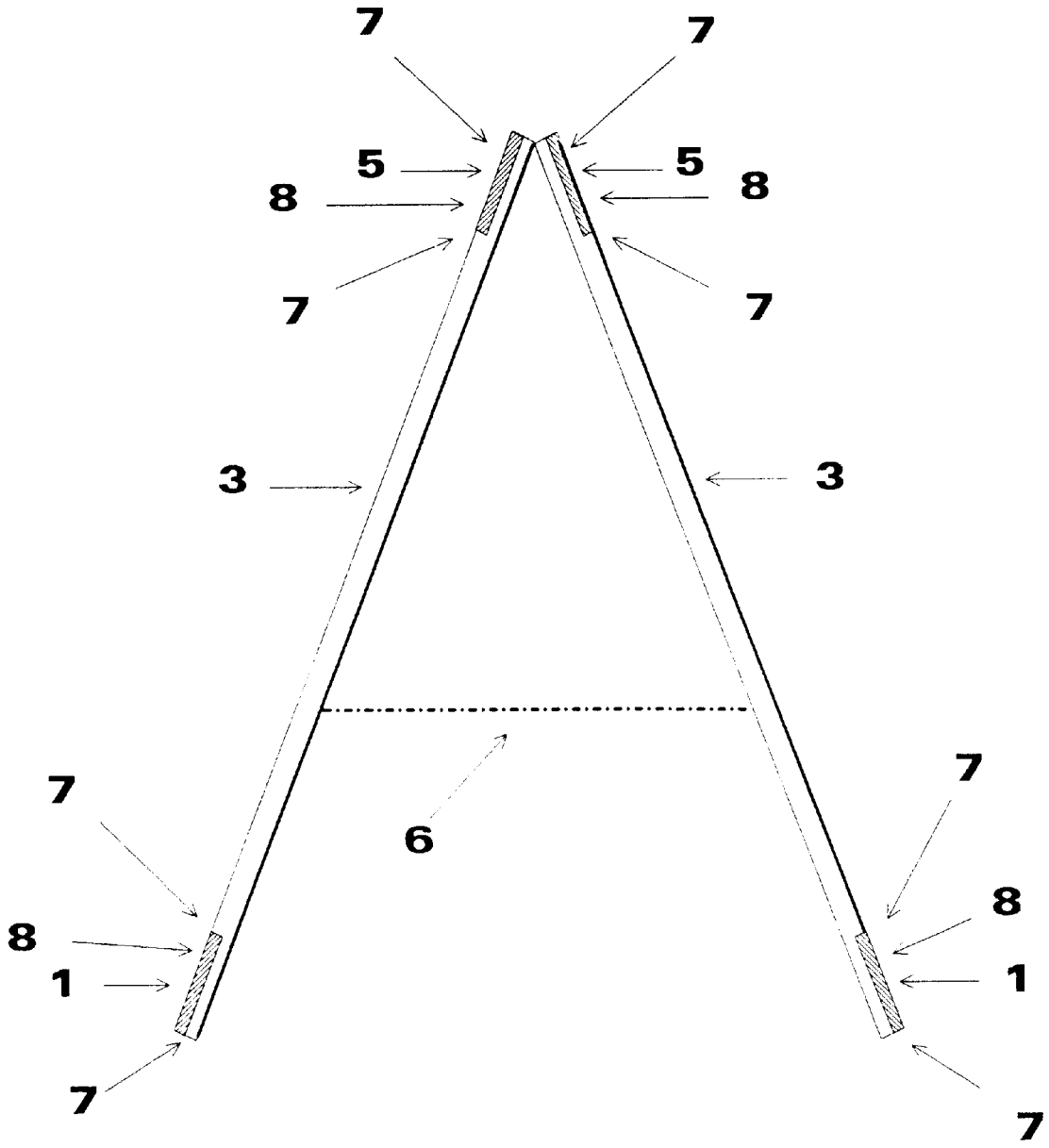
FIG. 1, shows the end elevation of the sawhorse of this invention fully assembled, and in it's stable work position, forming an "A" shape; with the frames being the oblique lines of the "A" shape; the hinges 4 (not visible in this view) located at the pinnacle of the "A" shape; and the chain 6 forming the cross of the "A" shape. This sawhorse can be summed up as having two frames; with each frame incorporating four boards; one top board 5 two side boards 3 and one bottom board 1; two hinges 4 with screws connect the two top boards 5 to enable the first frame to pivot with respect to the second frame about a hinged axis, and two chains 6 connect with four fasteners 2 (not visible in this view) the two side boards 3 of one frame to the two side boards 3 of the other frame, establishing a maximum spread of the two bottom boards 1.
Figure 2:
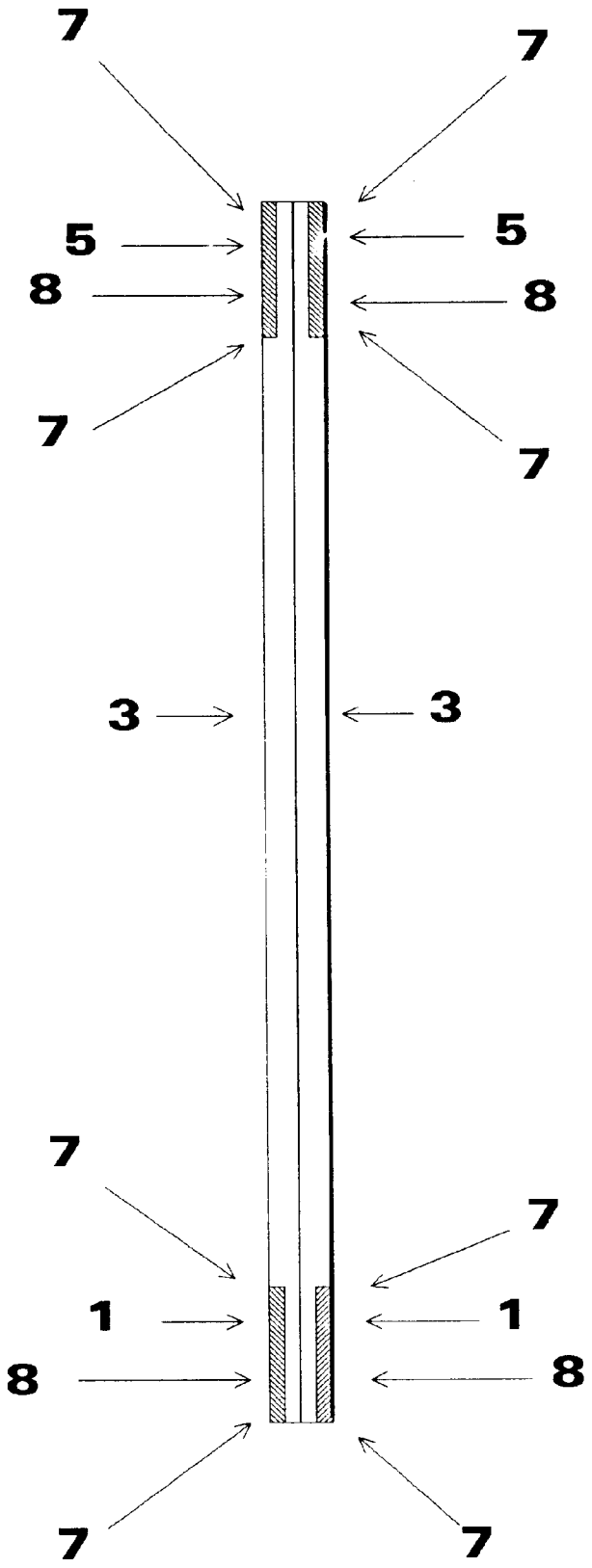
FIG. 2, shows the end elevation of the sawhorse of this invention fully assembled, and in it's folded for storage position.
Figure 3:
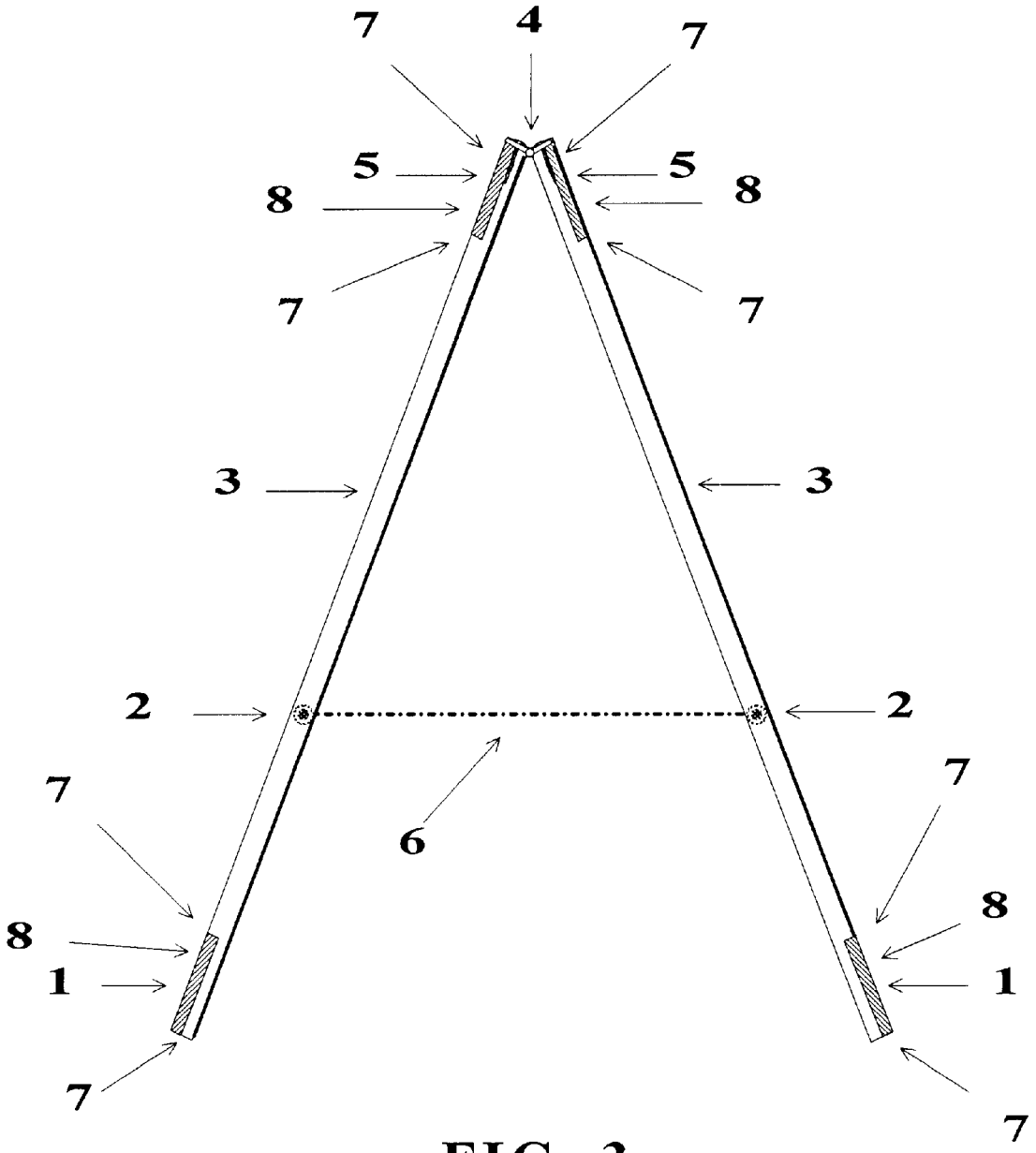
FIG. 3, is a partial cutaway view; allowing the view of the hinges 4, screws, chains 6 and fasteners 2 in it's stable work position.
Figure 4:
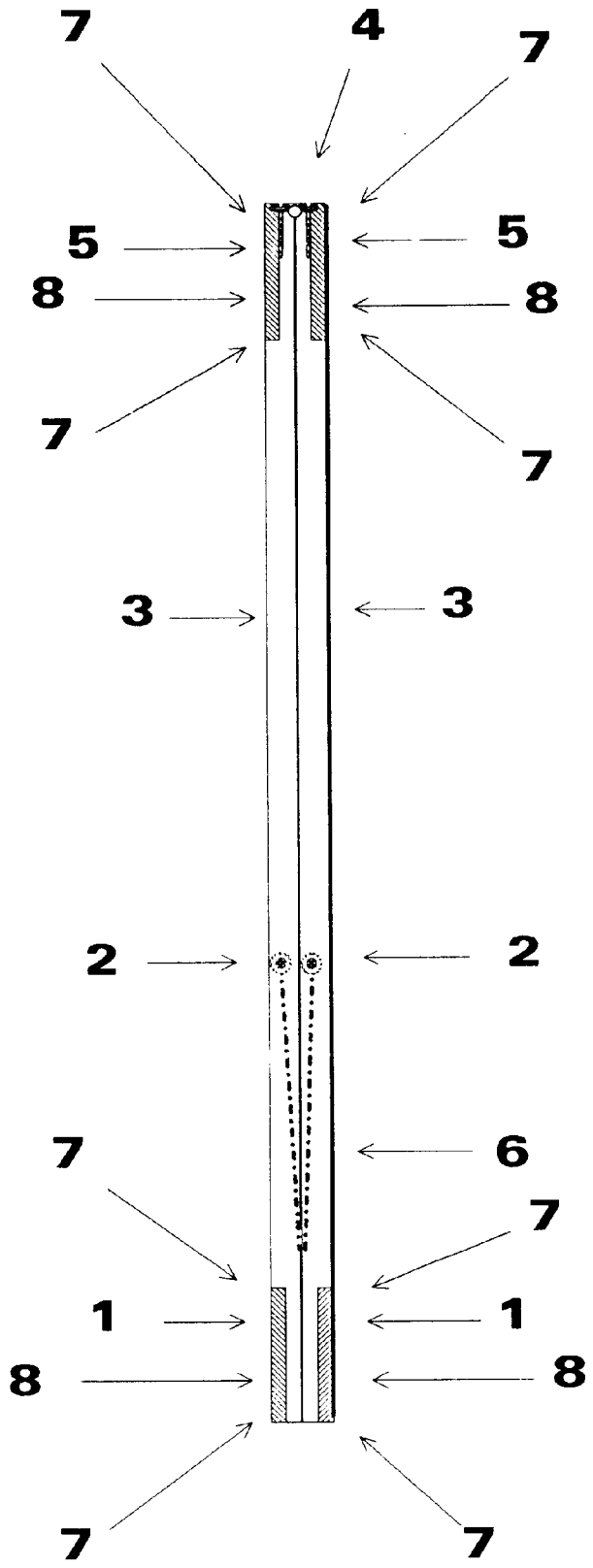
FIG. 4, is a partial cutaway view; allowing the view of the hinges 4, screws, chains 6 and fasteners 2 in it's folded for storage position.
Figure 5:
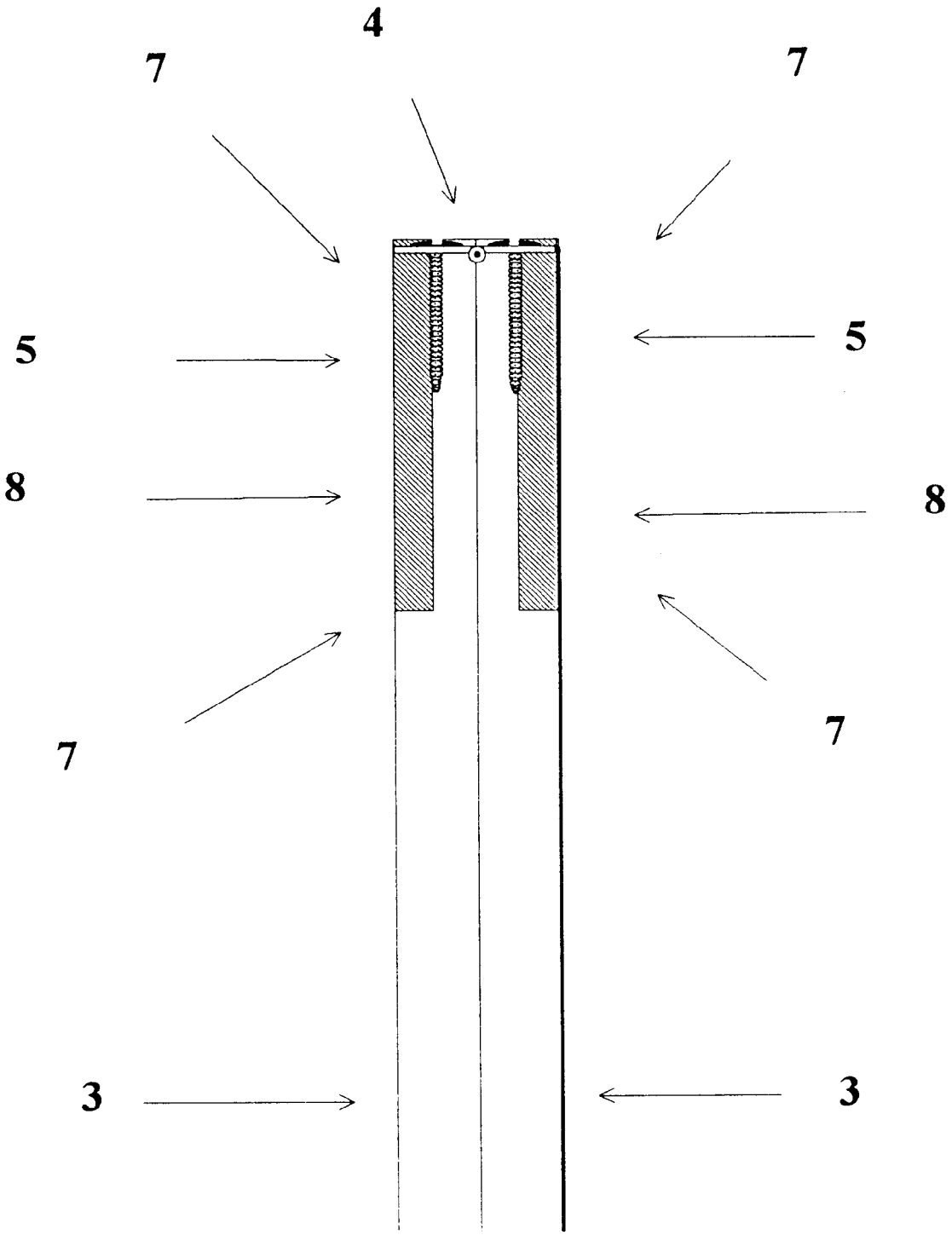
FIG. 5, is a partial cutaway, enlarged view; showing the positioning of the hinges 4, and screws, in it's folded for storage position.
Figure 6:
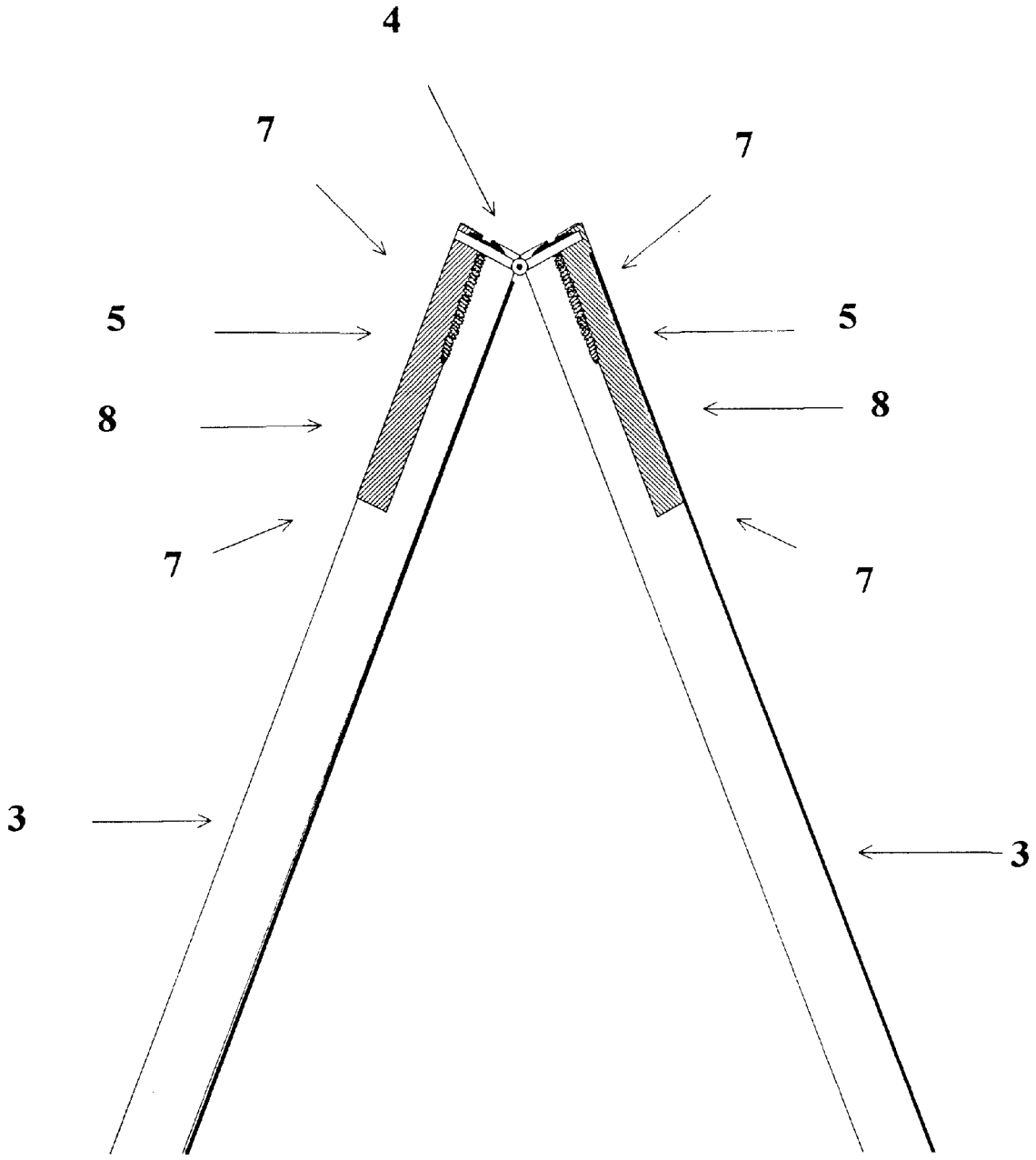
FIG. 6, is a partial cutaway; enlarged view; showing the position of the hinges 4, and screws, in it's stable work position.
Figure 7:
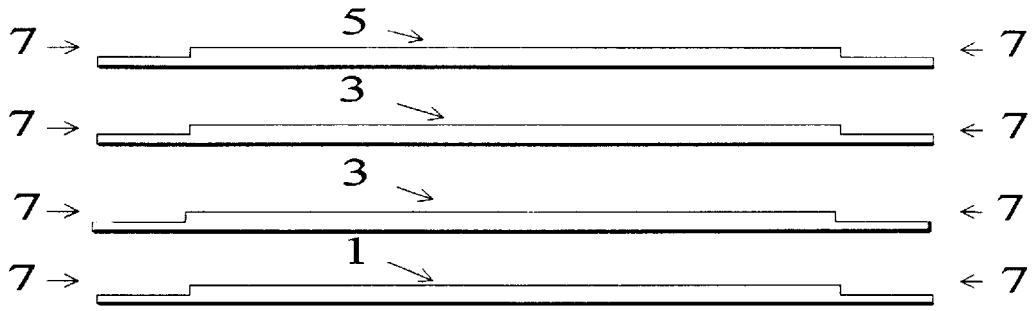
FIG. 7, shows an edge view with each of the four boards, required for one frame, notched 7 by removing the wood; the area of the width multiplied by the width, on each end of each of the four boards, to one half the thickness of the board used. If using 1 inch by 4 inch lumber; with a real measurement of ¾ inch by 3½ inches; each notch 7 would be 3½ inches by 3½ inches by ⅜ inch.
Figure 8:
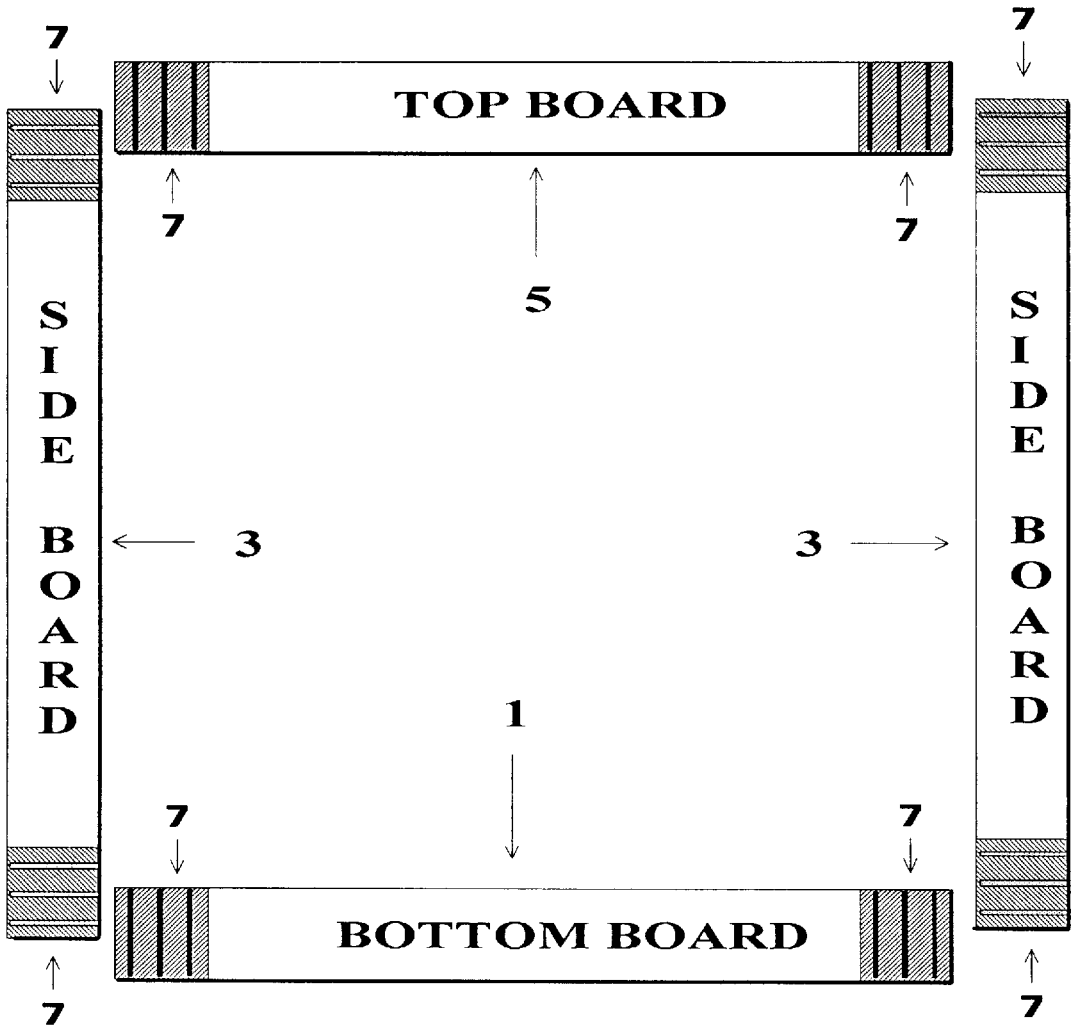
FIG. 8, shows an aerial view of the four boards; one top board 5, one bottom board 1, and two side boards 3 needed to complete one frame; with glue in place and ready for assembling. The two side boards 3 will be inverted; and each placed, one notch of side board 3 against the notch of top board 5, and the other notch of side board 3 against the notch of bottom board 1, and clamped in place until the glue cures.
Figure 9:
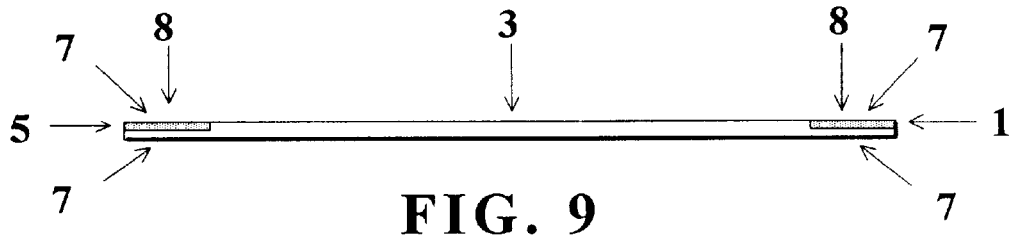
FIG. 9, shows an edge view of a completed frame lying flat; a side board 3 with the top board 5 and the bottom board 1 glued in place.
Figure 10:
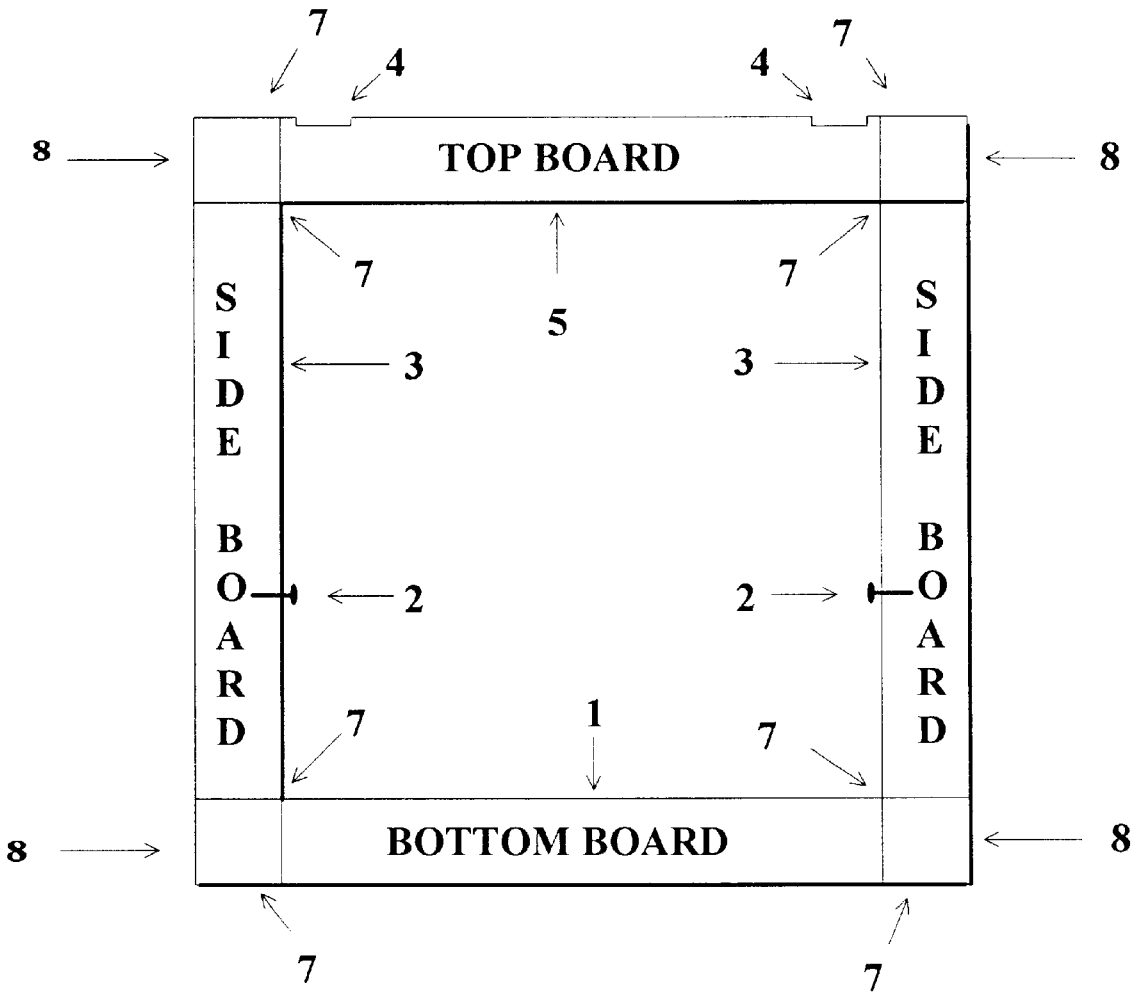
FIG. 10, shows a side view of one frame in the vertical position. The hinges 4 should be recessed into the top edge of the top boards 5, so as not to protrude when folded for storage, and located just inside the side boards 3. The recess for the hinge 4 should be no longer than the hinge 4 nor deeper than the thickest part of the hinge 4. The boards at each corner should be held at 90 degrees to one another until the glue joint 8 is cured. The frame is complete when it has four boards, with glued joints 8 at all notches 7 with square corners.
Figure 11:
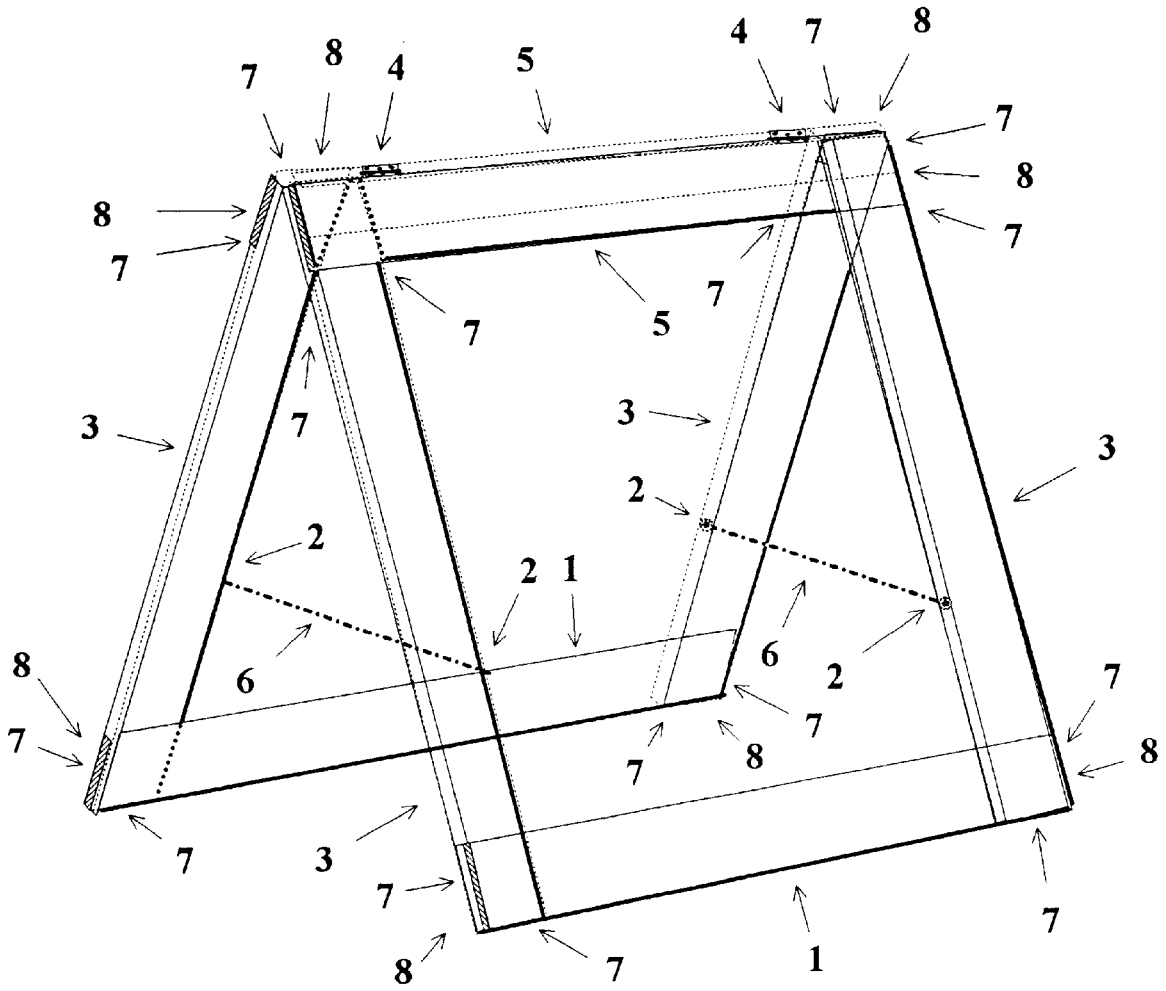
FIG. 11, shows a perspective view of the sawhorse and it's components. The preferred lumber size and type is: 1 inch by 4 inch Yellow, Southern or Pitch Pine, kiln dried to 15 to 19% moisture content. Total boards required for one sawhorse is eight boards, all boards should be the same length, and square cut. The inventor recommends that each of the eight boards be 32 inches long over all. The sawhorse in the stable work position, would then measure 32 inches in length, 24 inches wide at the base and is 30 inches high. The two chains 6 are each fastened 2, one end to the interior edge (see FIG. 10) of the side boards 3 on this frame, and the other end of the two chains 6 are fastened 2 to the interior edge of the side boards 3 on the other frame. The chain 6 should be 15 inches long; and fastened 2 12 inches up from the bottom of the bottom board 1 so that the chain 6 in the folded; sawhorse ready for storage position; is not hanging so low as to be between the bottom boards 1 (See FIG. 4). The chain 6 should be fastened 2 to the frames with a 2 inch screw in prior drilled holes, with a shear strength greater than the working load rating of the chain 6.
Figure 12:
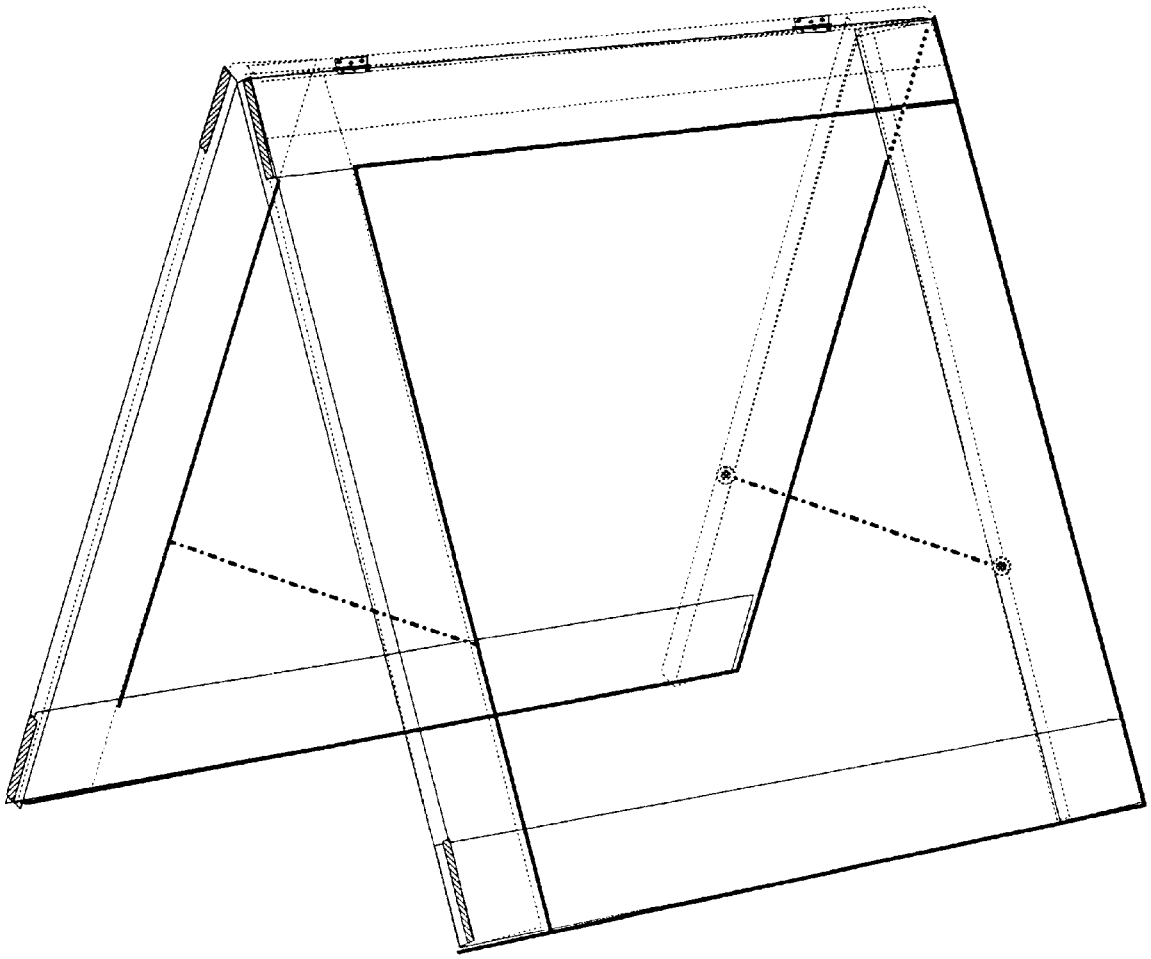
FIG. 12, shows a perspective view of the sawhorse and all it's components without description.

This folding sawhorse forms an "A" shape in it's stable work position and includes: (a) two frames; (b) two hinges with screws, (c) two chains with fasteners and (d) transcends the full sized sawhorse in it's stable work position to it's folded storage position instantly and uncomplicated.

(a) A "frame" is described as having one top board, two side boards, and one bottom board. The two frames form the two oblique sides of the "A" shaped sawhorse in the stable work position. Each frame has four 1 inch by 4 inch boards; Yellow, Southern or Pitch Pine preferred, that are cut 32 inches long. Notched by removing the wood, the area of the width multiplied by the width, on each end of each of the four boards, to one half the thickness of the board used. If using 1 inch by 4 inch lumber; with a real measurement of ¾ inch by 3½ inches; each notch would be 3½ inches by 3½ inches by ⅜ inch. The boards are then glued together at the corners, the notch in this board glued to the notch in that board. A frame is completed when these four boards are glued together at the notches 90 degrees one to another. When the frame is complete, and lying on the floor, it should be 32 inches long 32 inches wide and ¾ inch high, and square.

(b) The two hinges lock the top boards of the two frames in close proximity, and are at the pinnacle of the "A" shape when the sawhorse in it's stable work position. Two hinges connect the two top boards of two frames, so as to enable the first frame to pivot with respect to the second frame about a hinged axis. The hinged axis extends basically parallel to the longitudinal axis of the top boards associated with both the first and second frame. The hinge's screws have very little stress upon them, and no withdrawal of the screws stress. Standing up two frames with their top boards, side boards, and bottom boards touching; install two 1½ inch by 2 inch hinges across the top of the two top boards, and located just inside the side boards. Inventors also suggest that the hinges be recessed into the top boards so as not to protrude, when folded for storage.

(c) The chains form the cross of the "A" shaped sawhorse in the stable work position. Two chains hold the two side boards of one frame to the two side boards of the other frame, establishing a maximum spread of the bottom of the frames. The chain material preferred is zinc plated Inco chain; sometimes referred to as porch swing chain, or runner & kennel chain. Each of the two chains used, should have a working load of 5% of the vertical load limit. The chain should be fastened; in the horizontal position to the frames with a 2 inch screw into previously drilled holes. The screws shall have a shear strength greater than, the working load rating of the chain. One end of the two chains are fastened to the interior edge of the side boards on this frame, and the other end of the two chains are fastened to the edges of the side boards on the other frame. The chain should be 15 inches long; and fastened 12 inches up from the bottom of the bottom boards; so that the chain in the folded, sawhorse ready for storage position, is not hanging so low as to be between the bottom boards.

(d) Simply by setting down the nearer frame, and with a slight twist of the wrist set the bottom of the other frame away until the "A" shape is formed and the sawhorse is in it's stable work position. Simply by picking up the sawhorse; it is ready for storage, when the bottoms of both frames clear the floor, gravity folds the sawhorse to it's ready for storage position. The rectilinear volume of this folding sawhorse; in it's stable work position, is 23040 cubic inches being 32 inches long, 24 inches wide at the base and 30 inches high. The rectilinear volume of this folding sawhorse; in it's folded and ready for storage, is 1536 cubic inches being 32 inches long, 1½ inches wide at the base and 32 inches high. The reduction ratio between the stable work position and the folded for storage position therefore is fifteen (15) to one (1). A pair of these sawhorses weigh less than a three gallon pail of water; while supporting vertical loads in excess of one thousand pounds and can easily be handled by a one armed person. All components of this folding sawhorse can be readily found at the local store.

Although the invention has been described in its preferred forms with a certain degree of particularity, it is understood that the present disclosure of the preferred forms is only by way of example and that numerous changes in details of construction and the combination and arrangement of parts may be resorted to without departing from the spirit and scope of the invention as hereinafter claimed.

I claim:

1. A folding sawhorse, comprising:

a first frame having upper, lower, and side members, each member having first and second end portions defined by notched portions with said end portions of said upper and lower members being coupled to the end portions of one of the side members at a top and bottom edge thereof, respectively via a lap joint, the first frame members forming a generally closed polygon;

a second frame having upper, lower, and side members, each member having first and second end portions defined by notched portions with said end portions of said upper and lower members being coupled to the end portions of one of the side members at a top and bottom edge thereof, respectively via a lap joint, the second frame members forming a generally closed polygon;

a hinge extending between a top portion of the upper member of the first frame and a top portion of the upper member of the second frame to allow said frames to pivot about an axis adjacent said upper member top portions between a first position wherein said first and second frames are substantially parallel and adjacent and a second position wherein said first and second frames are spaced apart; and a flexible member extending between said first and second frames displaced from said hinge.

2. A folding sawhorse, as set forth in claim 1, wherein said members are substantially rectangular in cross section, having a preselected height and width, and said end portions have a height of approximately one-half the preselected height over a length substantially corresponding to the preselected width.

3. A folding sawhorse, as set forth in claim 1, wherein said flexible member is a chain.

4. A folding sawhorse, as set forth in claim 1, wherein said members are substantially identical.

5. A folding sawhorse, as set forth in claim 1, wherein said hinge includes first and second spaced apart hinges.

6. A folding sawhorse, comprising:

a first generally rectangular frame having substantially identical upper, lower and side members, each member having first and second end portions defined by notched portions with said end portions of said upper and lower members being coupled to the end portions of one of the members at a top and bottom edge thereof, respectively via a lap joint, the first frame members forming a generally closed polygon;

a second generally rectangular frame having substantially identical upper, lower, and side members, each member having first and second end portions defined by notched portions with said end portions of said upper and lower members being coupled to the end portions of one of the side members at a top and bottom edge thereof, respectively via a lap joint, the second frame members forming a generally closed polygon;

a hinge extending between a top portion of the upper member of the first frame and a top portion of the upper member of the second frame to allow said frames to pivot about an axis adjacent said upper member top portions between a first position wherein said first and second frames are substantially parallel and adjacent and a second position wherein said first and second frames are spaced apart; and a flexible member extending between said first and second frames displaced from said hinge to limit pivoting movement of said first and second frames.

7. A folding sawhorse, as set forth in claim 6, wherein said members are substantially rectangular in cross section, having a preselected height and width, and said end portions have a height of approximately one-half the preselected height over a length substantially corresponding to the preselected width.

8. A folding sawhorse, as set forth in claim 6, wherein said flexible member is a chain.

9. A folding sawhorse, as set forth in claim 6, wherein said hinge includes first and second spaced apart hinges.

* * * * *